United States Patent [19]

Jones, Jr. et al.

[11] 4,448,384

[45] May 15, 1984

[54] ADJUSTABLE MUSIC/BOOK HOLDER

[76] Inventors: Larry L. Jones, Jr., 206 S. Collins St., Nashville, N.C. 27856; Star D. Cockrell, 1315 Beal St., Rocky Mount, N.C. 27801

[21] Appl. No.: 451,486

[22] Filed: Dec. 20, 1982

[51] Int. Cl.[3] ..... G10G 5/00

[52] U.S. Cl. ..... 248/443; 248/448; 248/453

[58] Field of Search ..... 248/441 R, 441 B, 441 D, 248/443, 445, 446, 447, 448, 450, 451, 452, 453, 460–465; 40/341, 11 A, 531; 297/135; 312/233; 84/180

[56] References Cited

U.S. PATENT DOCUMENTS 700,523 5/1902 Manuel ..... 248/448

1,033,660 7/1912 Beecher ..... 248/465.2

4,150,807 4/1979 Manso ..... 248/460

FOREIGN PATENT DOCUMENTS 636793 2/1962 Canada ..... 248/465.2

*Primary Examiner*—William H. Schultz

*Assistant Examiner*—Robert A. Olson

*Attorney, Agent, or Firm*—B. B. Olive

[57] ABSTRACT

An adjustable music/book holder is adaptable for being supported on a piano, organ, or conventional music stand. The holder comprises a pair of frame members which adjustably receive a pair of page holder members, a pair of hook/alternate page holder members as well as a central book safety or alternative accessory member.

6 Claims, 9 Drawing Figures

ADJUSTABLE MUSIC/BOOK HOLDER

DESCRIPTION

TECHNICAL FIELD

The present invention relates to adjustable racks or holders for sheet music and/or books and particularly to a holder which may be mounted on a piano, organ, or conventional music stand.

BACKGROUND ART

Needless to say prior art in the area of music/book holders is voluminous. Illustrative of the art are U.S. Pat. Nos. 493,936; 932,348; 948,955; 1,047,879; 1,092,625; 1,923,318 and 3,076,285. While the mentioned patents overall teach various types of adjustable racks adapted to hold sheet music or books and to rest on a piano, organ, music stand, or the like, such patents do not teach or suggest and applicant is unaware of any prior art apparatus which teaches or suggests the combination of features of the present invention. The object of the present invention thus becomes that of providing an improved adjustable music/book holder which is adaptable for use on various styles of pianos, organs, or music stands, and which maintains the pages in place while allowing for ease in turning or flipping of the pages by the user.

DISCLOSURE OF INVENTION

In accordance with the present invention, applicant provides an adjustable music/book holder comprising a lower, transverse, relatively heavy or weighted metal bar frame member with downwardly extending, metal rod-formed, integral rubber-tipped feet, a first pair of metal rod-formed rotatable page holders which have lower U-shaped page engaging portions and support rod portions which rotate within the lower frame member and extend upward therefrom, an upper transverse metal sheet frame member which rotatably receives the mentioned upper support rod portions, a second pair of metal rod-formed hook/alternate page holder members which rotate and adjust vertically on the outer ends of the upper frame member and have inverted U-shaped page or support surface engaging portions, and a metal, rod-formed book safety member which is removable, rotates, and ajusts vertically in a sleeve at the center of the upper frame member. All of the mentioned metal bar, rod and sheet parts are formed as rigid members. The adjustability of the piano, organ, or stand-engaging members and the adjustability of the music/book engaging members provide a highly versatile and adaptable music/book holder.

BEST MODE FOR CARRYING OUT THE INVENTION

Figure 1:
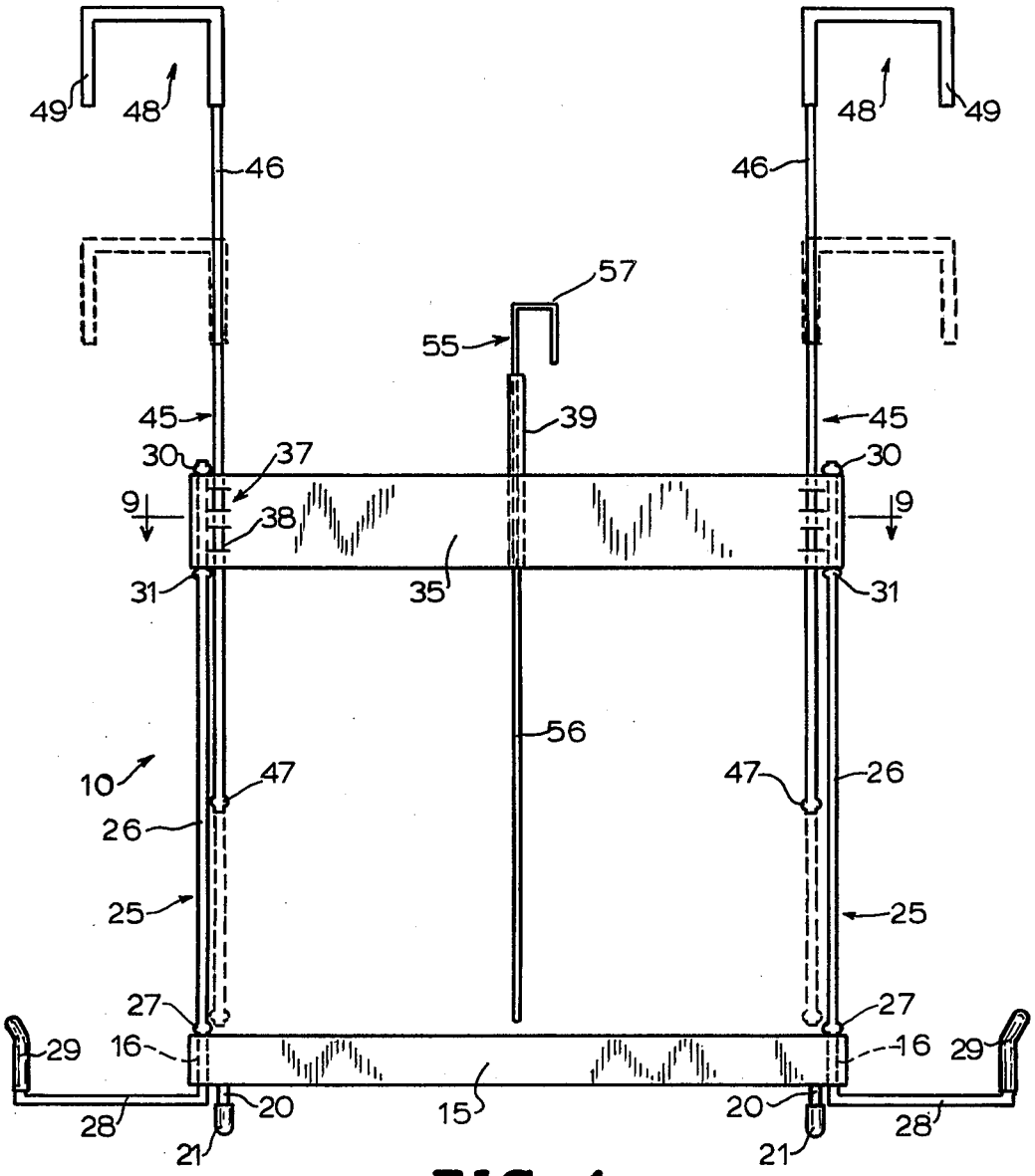
FIG. 1 is a front elevation view of the adjustable music/book holder of the present invention with alternate positions indicated by dashed lines.
Figure 4:
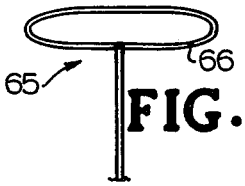
FIG. 4 is a pictorial view of an alternative flat, elliptical-shaped hook accessory member.
Figure 5:
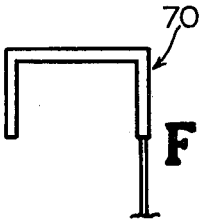
FIG. 5 is a pictorial view of a second alternative inverted U-shaped hook accessory member.
Figures 2, 3:
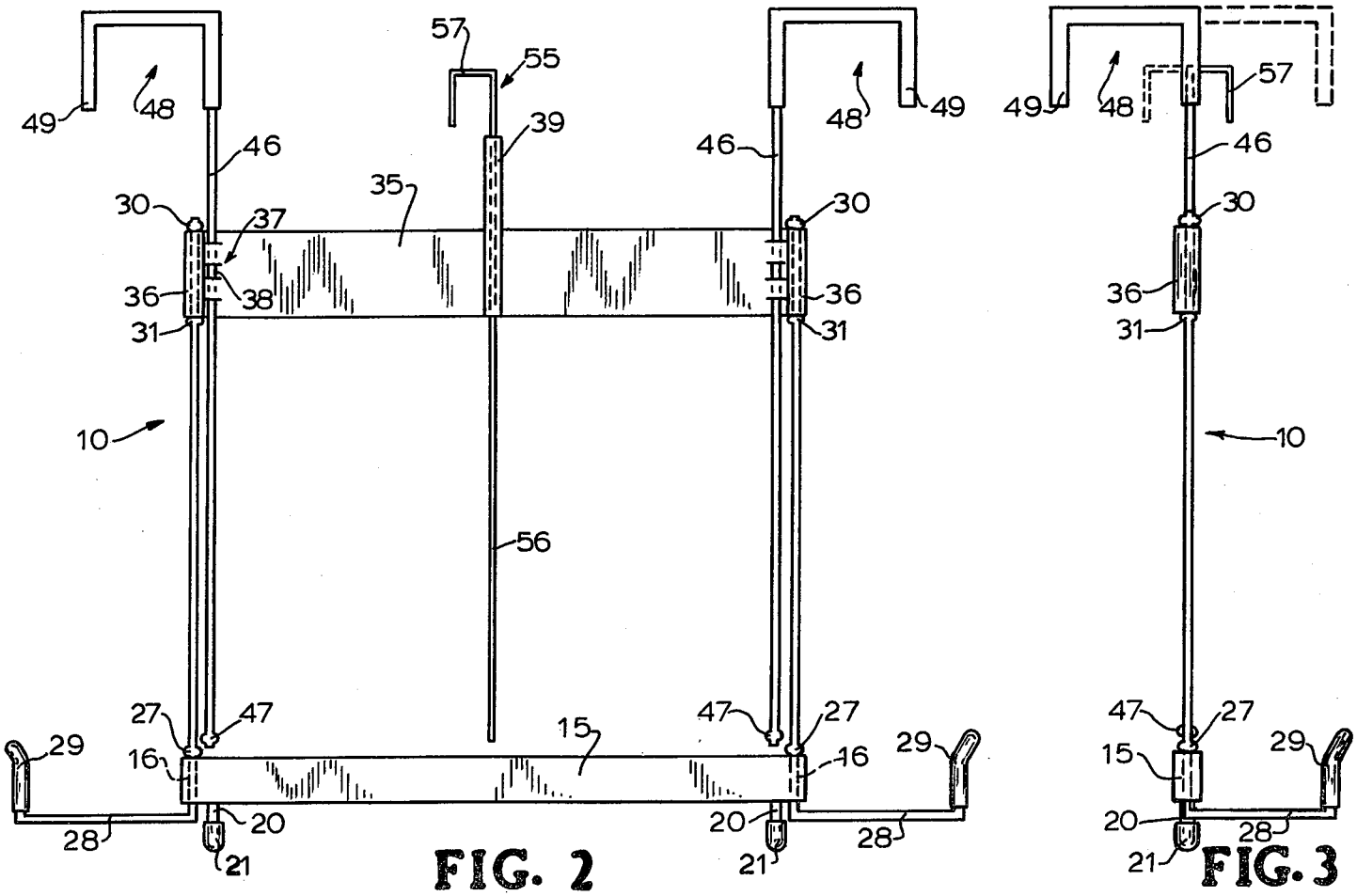
FIG. 2 is a rear elevation view of the holder of FIG. 1.
FIG. 3 is a side elevation view of the holder of FIG. 2.

Referring to the drawings, an adjustable music/book holder 10 constructed in accordance with the present invention comprises a lower, relatively heavy or weighted, transverse, metal bar frame member 15 with integral metal rod-formed supports of feet 20, a first pair of metal rod-formed page holders 25, an upper relatively lightweight metal sheet transverse frame member 35, a second pair of metal rod-formed hook/alternate page holder members 45 and a metal rod-formed book safety member 55. Accessory items shown in FIGS. 4 and 5 may be used in place of safety member 55.

In one embodiment, a $\frac{1}{8}$ inch steel rod was employed for feet 20, page holders 25 and members 45 and 55. The lower transverse member 15 was made $\frac{1}{4}$ inch thick, $\frac{1}{2}$ inch wide, and $6\frac{3}{4}$ inches long and was made of solid, cold rolled steel to provide the desired weight effect. The upper transverse member 35 had its longitudinal axis parallel to the longitudinal axis of member 15 and was $6\frac{1}{2}$ inches long, $\frac{3}{4}$ inch wide, and 1/32 inch thick and was formed of cold rolled steel sheet. Other members mentioned later in the description were made and sized accordingly. A substantially rigid construction is thus provided.

Feet 20 extend vertically downwardly from and are integrally secured to the base of frame member 15 by welding or other suitable means. Also, feet 20 preferably have rubber tips 21 or are otherwise treated to prevent scarring or damage to the surface on which holder 10 rests during use. Holes 16 formed in the outer ends of lower, weighted transverse member 15 receives support rod portions 26 of page holders 25. Rod portions 26 rotate within holes 16 and are prevented from sliding axially by crimps 27, 30 and 31. The lower page-engaging portions 28 of page holders 25 are U-shaped with the free ends of the U's having rubber tips 29 or being otherwise treated to enhance securement of the held pages.

Transverse upper frame member 35 rotatably receives the upper support rod portions 26. Frame member 35 is formed with the outer ends bent rearwardly to form a pair of sleeves 36 which receive the upper support rod portions 26. The ends of portions 26 extending through sleeves 36 utilize crimps 30, 31 to prevent rod portions 26 from sliding axially in upper frame member 35. Crimps 27, 30 and 31 thus limit the upward and downward movement of page holders 25 with respect to frame members 15 and 35 while still allowing rotation of holders 25 in the frame members.

Upper frame member 35 is slit and crimped at 37 to form slots 38 therein adjacent sleeves 36 on either end thereof. Slots 38 receive in a sliding, rotatable manner hook/alternate page holder members 45. Holder members 45 have elongated rod portions 46 which reside parallel to rod portions 26 and in slots 38 with the lower ends of rod portions 46 having crimps 47 to prevent rod portions 46 from sliding out of slots 38 in an upward vertical direction. The upper end portions 48 of holder members 45 have an inverted U-shape with the U-shaped portions having a rubber coating 49 or being otherwise treated to prevent scratching or damage to instrument surfaces. The length of elongated rod portions 46 limits the downward sliding of hook-alternating page holders 45 since the lowermost ends and crimps 47 are aligned to butt against the top surface of frame member as a stop. Substantially midway of upper frame member 35 and integral with the back surface thereof is a metal sleeve member 39 oriented axially parallel to rod portions 26 and 46 and which is integrally secured by welding or other suitable means. Sleeve 39 receives a rotatable and slidable book safety member 55 having an elongated rod portion 56 and an upper U-shaped hook portion 57. Safety member 55 is capable of being removed from sleeve 39 and an alternate flat, elliptical-shaped hook member 65 or inverted U-shaped hook member 70 installed in its place. Book safety member 55 is adapted to reside in the center back area of a book being held with the hook portion 57 holding the book in place. Alternatively, members 65 or 70 can be used for other book holding or support situations.

Figure 7:
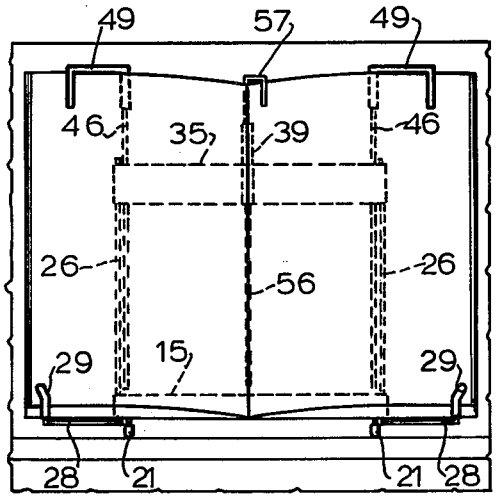
FIG. 7 is a front elevation view, similar to FIG. 6, but illustrating the holder supported on the piano or organ by the foot members only.
Figure 6:
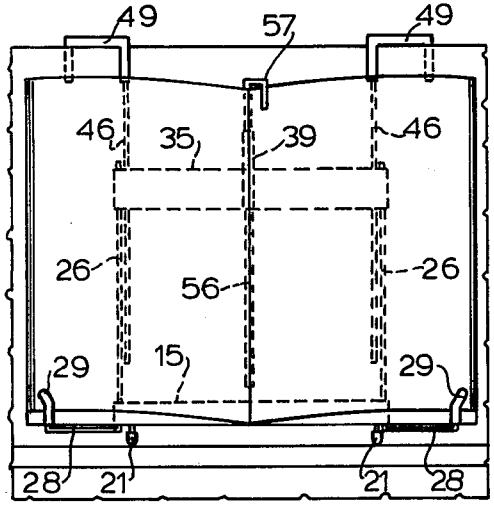
FIG. 6 is a front elevation view, on a reduced scale, of the invention holder supported on the foot members and also held by the hook members on a typical piano or organ.

In use on a piano or organ where the instrument has a ledge or shelf for supporting books and music, the arrangement of FIG. 6 or 7 is employed. In this form, feet 20 rest on the ledge or shelf and the weight of holder 10 maintains it in place thereon. A book is opened to the desired page and the book is allowed to sit on U-shaped portions 28 of holders 25 with the pages thereof residing behind the rubber tips 29 of U-shaped portion 28. Page holders 25 may be rotated either clockwise or counterclockwise so that tip portions 29 reside against the pages front surface to prevent page movement except when desired by the musician or the musician's assistant. Holder members 45 can be raised while the book is being inserted into holder 10 and then members 45 can be allowed to slide downward and grasp a supporting surface as in FIG. 6 or hold the book and pages thereunder, as in FIG. 7. The rubber coating 49 aids in both grasping the support surface and in retaining the held pages within members 45 during use.

Figure 8:
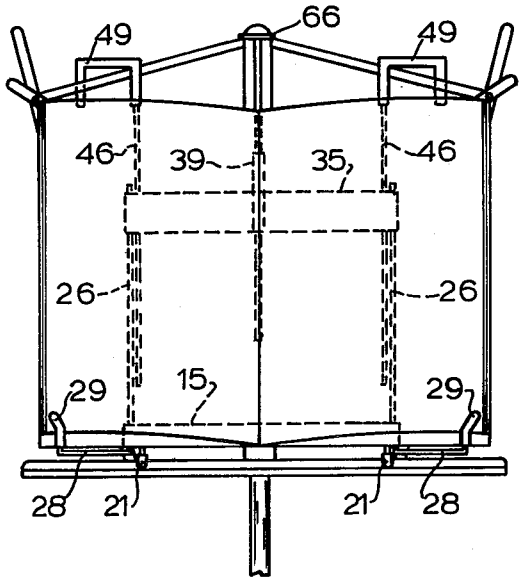
FIG. 8 is a front elevation view, similar to FIGS. 6 and 7 but illustrating the holder being used in conjunction with a Hamilton-type music stand.
Figure 9:
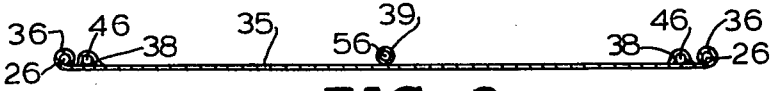
FIG. 9 is a plan view taken along line 9—9 of FIG. 1.

Further, as best seen in FIG. 8, book safety member 55 can be removed from sleeve 39 and a music stand accessory member such as flat, elliptical-shaped hook member 65 inserted in sleeve 39 with the circular portion 66 thereof resting on a portion of the music stand. Alternatively, the replacement music stand accessory member 70 may be employed if more suited to the situation.

As can be seen from the foregoing description in conjunction with the drawings, holder 10 thus provides a highly versatile holder for books, sheet music, and the like, and which is readily adaptable for either piano, organ, or music stand use. Of particular advantage is the fact that in use, the pages or leaves of music being held by holder 10 may be flipped easily from underneath page holders 25 and holder members 45 and placed under opposed holders as playing of the music proceeds during a performance.

What is claimed is:

1. An adjustable music/book holder comprising:

(a) a lower, elongated, transverse, metal, frame member formed of a bar material and in such manner as to establish a predetermined weight effect to help maintain the holder positioned in use;

(b) a pair of metal rod-formed foot members formed integral with said lower frame member and extending vertically downward from the bottom and outer extremities thereof;

(c) an upper elongated transverse frame member formed of metal sheet material and fixedly positioned above and having its longitudinal axis parallel to the longitudinal axis of said lower frame member;

(d) a first pair of metal rod-formed page holders, each having an upper vertically positioned straight rod portion mounted for rotation in an outer end portion of each of said frame members and having a lower U-shaped portion swingable around an outer extremity of said lower frame member and being adapted for holding book or music pages therein;

(e) stop means operatively associated with said first page holder upper rod portions for limiting axial movement thereof relative to said frame members;

(f) a second pair of metal rod-formed hook/alternate page holders, each having a lower vertically positioned straight rod portion mounted for rotation in said upper frame member at the outer ends thereof and having an upper inverted U-shaped portion adapted for alternately holding book or music pages or structural surfaces against which said holder resides, the axes of said lower, straight rod portions of said second pair of hook/alternate page holders being parallel to the axes of said upper rod portions of said first pair of page holders;

(g) a sleeve member vertically positioned and integrally secured centrally and on said upper frame member with its longitudinal axis parallel to the axis of said first and second page holder rod portions; and (h) a support device having a lower metal rod-formed portion removably mounted, slidable and rotatable in said sleeve member and an upper metal rod-formed portion shaped to grasp a selected portion of a book, support surface, or the like.

2. An adjustable music/book holder as claimed in claim 1 wherein said upper portion of said support device is of an inverted U-shape.

3. An adjustable music/book holder as claimed in claim 1 wheren said upper frame member is formed with cylindrical sleeve-like portions at the outer ends thereof for rotatably receiving said first page holder upper rod portions and having inwardly from said cylindrical sleeve like portions pressed formations providing vertically aligned openings for slidably and rotatably receiving said second pair of hook/alternate page holder lower rod portions and wherein said sleeve member is secured to the back surface of said upper frame member.

4. An adjustable music/book holder as claimed in claim 1 wherein said stop means comprise crimps formed on said first pair of page holder upper rod portions at positions adapted to effect said limited axial movement.

5. An adjustable music/book holder as claimed in claim 3 wherein said stop means comprise crimps formed on said first pair of page holder upper rod portions at positions adapted to effect said limited axial movement and wherein said second pair of hook/alternate page holder lower rod portions are formed at the bottom ends thereof with means adapted to prevent vertical withdrawal through said vertical aligned openings.

6. An adjustable music/book holder comprising:

(a) a lower, elongated, transverse, metal, frame member formed of a bar material and in such manner as to establish a predetermined weight effect to help maintain the holder positioned in use;

(b) a pair of metal rod-formed foot members formed integral with said lower frame member and extending vettically downward from the bottom and outer extremities thereof;

(c) an upper elongated transverse frame member formed of metal sheet material and fixedly positioned above and having its longitudinal axis parallel to the longitudinal axis of said lower frame member;

(d) a first pair of metal rod-formed page holders, each having an upper vertically positioned straight rod portion mounted for rotation in an outer end portion of each of said frame members and having a lower U-shaped portion swingable around an outer extremity of said lower frame member and being adapted for holding book or music pages therein;

(e) stop means operatively associated with said first page holder upper rod portions for limited axial movement thereof relative to said frame members;

(f) a second pair of metal rod-shaped hook/alternate page holders, each having a lower vertically positioned straight rod portion mounted for rotation above said upper frame member around vertical axis extending through the outer ends thereof and having an upper inverted U-shaped portion adapted for alternately holding book or music pages or structural surfaces against which said holder resides, the axes of said lower, straight rod portions of said second pair of hook/alternate page holders being parallel to the axes of said upper rod portions of said first pair of page holders;

(g) a sleeve member vertically positioned and integrally secured centrally and on said upper frame member with its longitudinal axis parallel to the axis of said first and second page holder rod portions; and (h) a support device having a lower metal rod-formed portion removably mounted, slidable and rotatable in said sleeve member and an upper metal rod-formed portion shaped to grasp a selected portion of a book, support surface, or the like.

* * * * *

UNITED STATES PATENT AND TRADEMARK OFFICE

CERTIFICATE OF CORRECTION

PATENT NO. : 4,448,384

DATED : May 15, 1984

INVENTOR(S) : Larry L. Jones, Jr., & Star D. Cockrell

It is certified that error appears in the above—identified patent and that said Letters Patent is hereby corrected as shown below:

Col. 1, Line 47, "ajusts" should read --adjust--.

Col. 5, Line 7, "vettically" should read --vertically--.

Signed and Sealed this

*Eighteenth* Day of *September 1984*

[SEAL]

*Attest:*

GERALD J. MOSSINGHOFF

*Attesting Officer*

*Commissioner of Patents and Trademarks*